US010156814B2

(12) United States Patent
Ohata

(10) Patent No.: US 10,156,814 B2
(45) Date of Patent: Dec. 18, 2018

(54) DEVELOPING DEVICE INCLUDING A FILM MEMBER WHICH IS DISPOSED ON INNER WALL PORTION OF CASING AND IMAGE FORMING APPARATUS

(71) Applicant: KYOCERA Document Solutions Inc., Osaka (JP)

(72) Inventor: Shinobu Ohata, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/697,787

(22) Filed: Sep. 7, 2017

(65) Prior Publication Data

US 2018/0101111 A1 Apr. 12, 2018

(30) Foreign Application Priority Data

Oct. 6, 2016 (JP) ..... 2016-197805

(51) Int. Cl.
*G03G 15/08* (2006.01)
*G03G 15/095* (2006.01)

(52) U.S. Cl.
CPC ..... *G03G 15/095* (2013.01); *G03G 15/081* (2013.01); *G03G 15/0812* (2013.01); *G03G 15/0898* (2013.01); *G03G 15/0817* (2013.01); *G03G 2215/0805* (2013.01); *G03G 2221/1657* (2013.01)

(58) Field of Classification Search
CPC ..... G03G 15/095; G03G 15/081; G03G 15/0815; G03G 15/0846; G03G 15/0887; G03G 15/0898; G03G 2215/0872
USPC ..... 399/98, 264
See application file for complete search history.

(56) References Cited

U.S. PATENT DOCUMENTS

| | | | | |
|---|---|---|---|---|
| 8,494,400 | B2 * | 7/2013 | Kashimoto | G03G 15/0896 399/92 |
| 8,965,253 | B2 * | 2/2015 | Kusukawa | G03G 15/081 399/274 |
| 9,046,812 | B2 * | 6/2015 | Yamane | G03G 15/0806 |
| 9,158,229 | B2 * | 10/2015 | Ohashi | G03G 15/0812 |
| 2012/0201575 | A1 | 8/2012 | Kashimoto et al. | 399/272 |
| 2016/0048094 | A1 | 2/2016 | Kusukawa | |

FOREIGN PATENT DOCUMENTS

| | | | |
|---|---|---|---|
| JP | 2012-208469 | A | 10/2012 |
| JP | 2016-42133 | A | 3/2016 |

* cited by examiner

*Primary Examiner* — Robert Beatty
(74) *Attorney, Agent, or Firm* — Stein IP, LLC

(57) ABSTRACT

A developing device includes a developing roller, a toner supply roller, a casing, a film member, a biasing member, a link member, a link member drive mechanism, and an oscillation mechanism. The film member is disposed on an upper surface of an inner wall portion of the casing, with the biasing member coupled to one longitudinal end of the film member. The link member is coupled to the other longitudinal end of the film member. The link member drive mechanism drives the link member. The link member drive mechanism makes the link member intermittently pull the film member to thereby cause reciprocation of the film member in a longitudinal direction. The oscillation mechanism causes an upper end portion of the film member to oscillate in a direction orthogonal to the upper surface of the inner wall portion along with the reciprocation of the film member.

11 Claims, 10 Drawing Sheets

DEVELOPING DEVICE INCLUDING A FILM MEMBER WHICH IS DISPOSED ON INNER WALL PORTION OF CASING AND IMAGE FORMING APPARATUS

INCORPORATION BY REFERENCE

This application is based upon and claims the benefit of priority from the corresponding Japanese Patent Application No. 2016-197805 filed on Oct. 6, 2016, the entire contents of which are incorporated herein by reference.

BACKGROUND

The present disclosure relates to a developing device which supplies developer to an image carrier, and an electro-photographic image forming apparatus including the same.

An electro-photographic image forming apparatus forms an electrostatic latent image by irradiating a photosensitive layer formed on a surface of a photosensitive drum (image carrier) with light based on image information read from an original document, or image information obtained, by transmission and so on, from an external device such as a computer. The image forming apparatus supplies toner from the developing device to the electrostatic latent image to form a toner image, and then transfers the toner image onto a sheet (recording medium). The sheet that has gone through the transfer process is then subjected to toner-image fixing process, to be then discharged to outside.

As a developing method using a dry toner for image forming apparatuses using an electro-photographic process, there has been proposed a development method in which, when, by using a magnetic roller (toner supply roller), developer is transferred onto a developing roller disposed out of contact with a photosensitive drum (image carrier), a thin toner layer is formed by transferring only non-magnetic toner particles onto the developing roller, leaving magnetic carrier particles on the magnetic roller, and, in an opposing region (developing region) where the developing roller and the photosensitive drum face each other, toner particles are caused to jump to, and adhere to, an electrostatic latent image on the photosensitive drum by an AC electric field.

In recent years, more and more complicated configurations have come to be adopted in image forming apparatuses along with the progress in color printing and high-speed processing. In addition, for higher-speed processing, it is indispensable to achieve higher-speed rotation of a toner stirring member within the developing device. In particular, according to a developing method described above in which a two-component developer containing magnetic carrier and toner is used, and in which a magnetic roller which carries the developer and a developing roller which carries only the toner are used, in an opposing portion of the developing roller and the magnetic roller, a magnetic brush is formed on the magnetic roller, and by the magnetic brush, only the toner is caused to be carried on the developing roller, and further, the toner left unused for development is peeled off from the developing roller. Thus, with this method, toner particles are apt to float in the vicinity of the opposing portion of the developing roller and the magnetic roller, and such floating toner particles accumulate around a trimming blade (a regulation blade). If the accumulated toner particles adhere to the developing roller in a condensed manner, they may eventually fall and cause an image defect.

There is known a developing device using a two-component developer containing magnetic carrier and toner, and using a magnetic roller carrying the developer and a developing roller carrying only the toner, the developing device including, as a solution to the above-described problem, a toner receiver support member facing the developing or magnetic roller, a toner receiver member disposed along a longitudinal direction of the toner receiver support member to receive toner fallen from the developing roller, and vibration generating means for vibrating the toner receiver member.

There is also known a developing device having a film member fitted to an inner wall portion (sleeve cover) of a developing container, the inner wall portion opposed to a developing roller, such that, when a drive gear train for driving the developing device is rotated, a link member is caused by a link member drive mechanism to intermittently pull the film member to cause the film member to longitudinally reciprocate to thereby shake off toner particles accumulated on the film member.

SUMMARY

According to an aspect of the present disclosure, a developing device includes a developing roller, a toner supply roller, a regulation blade, a casing, a film member, a biasing member, a link member, a link member drive mechanism, and an oscillation mechanism. The developing roller is disposed opposite an image carrier on which an electrostatic latent image is formed, and, in an opposing region where the developing roller and the image carrier face each other, the developing roller supplies developer to the image carrier. The toner supply roller is disposed opposite the developing roller, and, in an opposing region where the toner supply roller and the developing roller face each other, the toner supply roller supplies toner to the developing roller. The regulation blade is disposed opposite the toner supply roller with a predetermined space therebetween. The casing holds therein the developing roller, the toner supply roller, and the regulation blade, and has an inner wall portion that is opposed to the developing roller between the regulation blade and the image carrier. The film member is flexible, and disposed on an upper surface of the inner wall portion. The biasing member is coupled to one longitudinal end of the film member to give tension to the film member. The link member is coupled to the other longitudinal end of the film member. The link member drive mechanism drives the link member. The link member drive mechanism makes the link member intermittently pull the film member to thereby cause reciprocation of the film member in a longitudinal direction. The oscillation mechanism causes an upper end portion of the film member to oscillate in a direction orthogonal to the upper surface of the inner wall portion along with the reciprocation of the film member.

Further features and specific advantages of the present disclosure will become apparent from the following descriptions of preferred embodiments.

DETAILED DESCRIPTION

Figure 1:
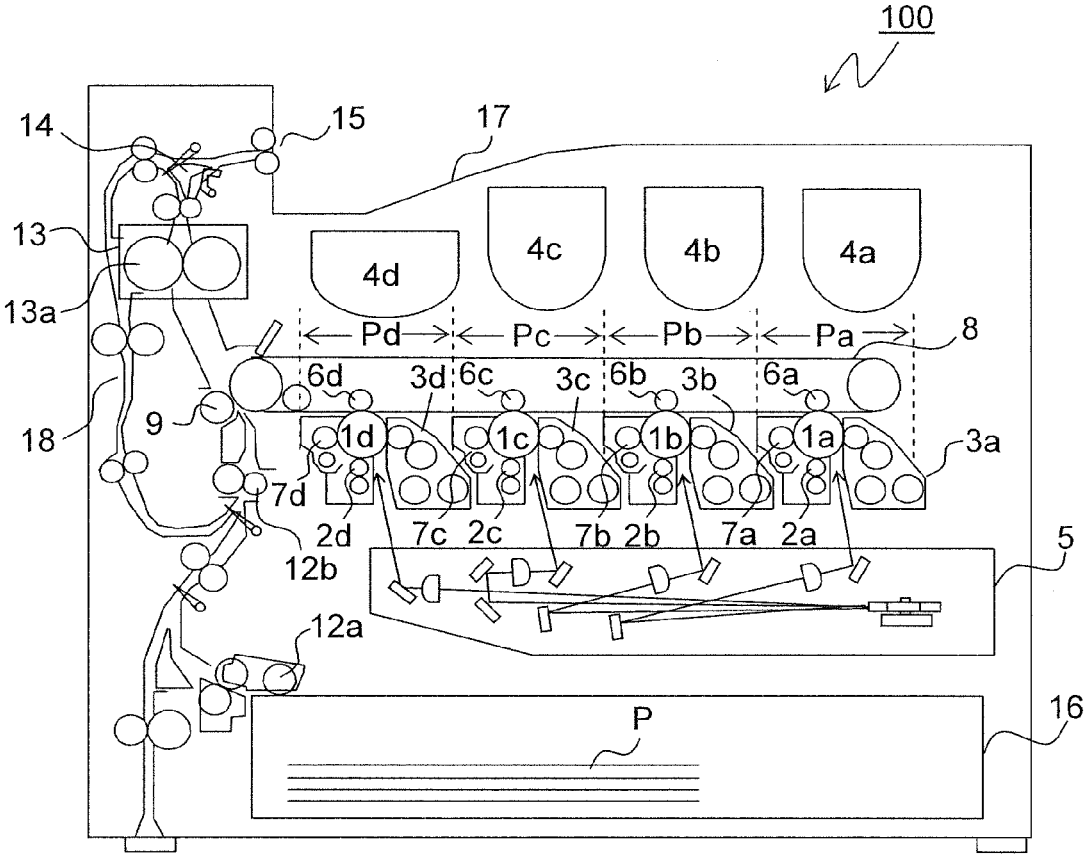
FIG. 1 is a diagram schematically showing a configuration of an image forming apparatus including a developing device of the present disclosure.

Hereinafter, embodiments of the present disclosure will be described with reference to the drawings. FIG. 1 is a schematic sectional view of an image forming apparatus incorporating developing devices 3*a* to 3*d* of the present disclosure, and the image forming apparatus shown herein is a tandem-type color printer. In a main body of a color printer 100, four image forming portions Pa, Pb, Pc, and Pd are arranged in this order from an upstream side in a conveyance direction (right side in FIG. 1). The image forming portions Pa to Pd are provided corresponding to images of four different colors (cyan, magenta, yellow, and black), and sequentially form images of cyan, magenta, yellow, and black through charging, exposure, developing, and transfer processes.

These image forming portions Pa, Pb, Pc, and Pd are provided with photosensitive drums 1*a*, 1 *b*, 1*c*, and 1*d*, respectively, which each carry a visible image (toner image) of a corresponding color, and further, an intermediate transfer belt 8 which rotates in a clockwise direction in FIG. 1 is provided adjacent to the image forming portions Pa to Pd.

When image data is inputted from a host device such as a personal computer, chargers 2*a* to 2*d* first charge surfaces of the photosensitive drums 1*a* to 1*d* uniformly. Then, an exposure device 5 irradiates the photosensitive drums 1*a* to 1*d* with light in accordance with the image data, to thereby form an electrostatic latent image on each of the photosensitive drums 1*a* to 1*d* in accordance with the image data. The developing devices 3*a* to 3*d* are each filled, by toner containers 4*a* to 4*d*, with a predetermined amount of two-component developer (which hereinafter may be referred to simply as developer) containing a toner of a corresponding one of the four colors of cyan, magenta, yellow and black, and toners contained in the developers are supplied by the developing devices 3*a* to 3*d*, and electrostatically adhere, to the photosensitive drums 1*a* to 1*d*. Thereby, toner images are formed corresponding to the electrostatic latent images formed by the exposure to the light emitted from the exposure device 5.

Then, by primary transfer rollers 6*a* to 6*d*, an electric field is applied at a predetermined transfer voltage between the primary transfer rollers 6*a*, 6*b*, 6*c*, and 6*d* and the photosensitive drums 1*a*, 1*b*, 1*c*, and 1*d*, respectively, and the toner images of cyan, magenta, yellow, and black on the photosensitive drums 1*a* to 1*d* are primarily transferred onto the intermediate transfer belt 8. After the primary transfer, residual toner and the like left on the surfaces of the photosensitive drums 1*a* to 1 *d* are removed by cleaning devices 7*a* to 7*d*.

A transfer sheet P onto which the toner images are to be transferred is accommodated in a sheet cassette 16 disposed in a lower portion inside the color printer 100, and the transfer sheet P is conveyed at a predetermined timing via a sheet feeding roller 12*a* and a registration roller pair 12*b* to a nip portion (secondary transfer nip portion) between the intermediate transfer belt 8 and a secondary transfer roller 9 provided adjacent to the intermediate transfer belt 8. The transfer sheet P onto which the toner images have been transferred is then conveyed to a fixing portion 13.

The transfer sheet P, which has been conveyed to the fixing portion 13, is heated and pressurized by a fixing roller pair 13*a*, whereby the toner images are fixed on a surface of the transfer sheet P, and thus a predetermined full-color image is formed. The transfer sheet P, on which the full-color image has been formed, is discharged onto a discharge tray 17 by a discharge roller pair 15 as it is (or after being directed by a branching portion 14 into a reverse conveyance path 18 and having an image formed on the other side, too).

Figure 2:
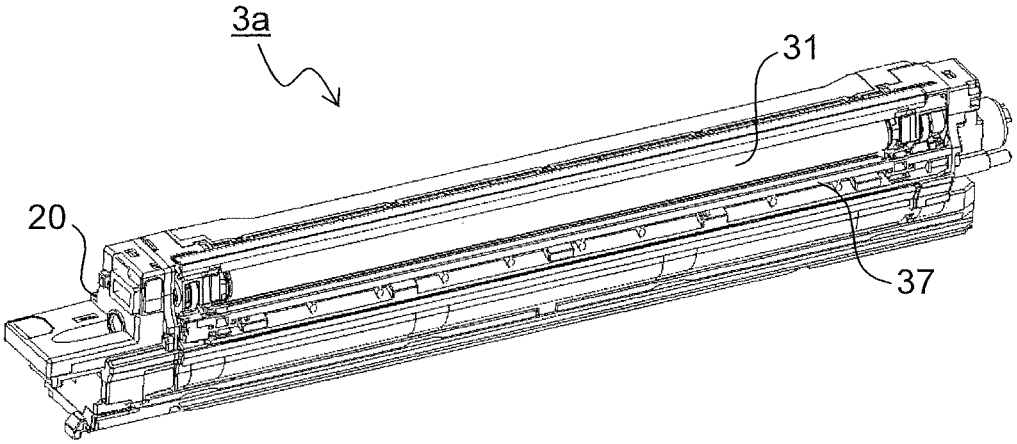
FIG. 2 is a perspective view of a developing device according to an embodiment of the present disclosure.
Figure 3:
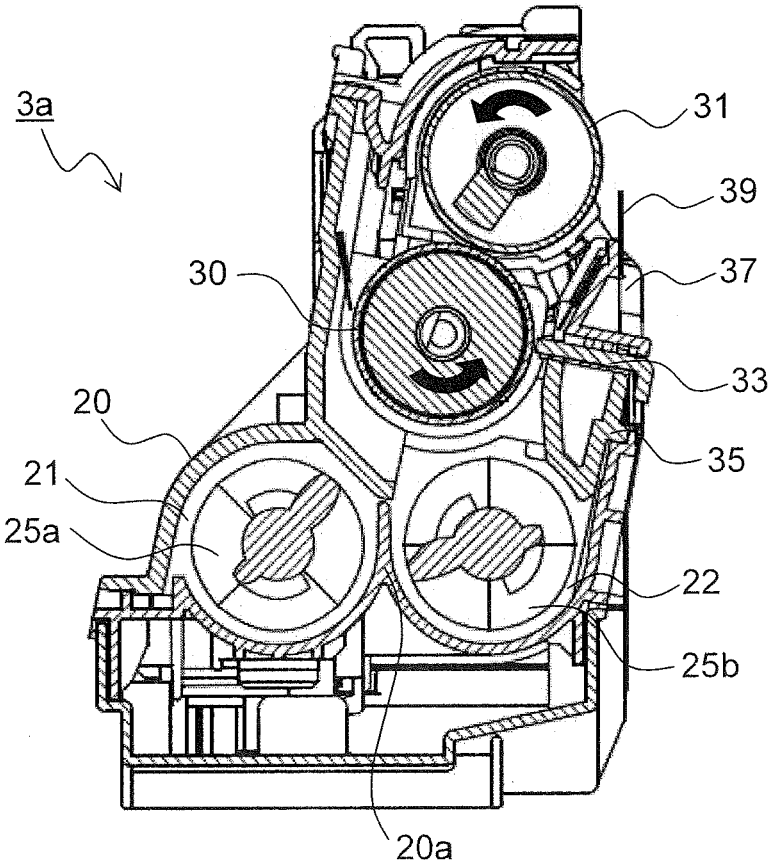
FIG. 3 is a side sectional view of the developing device of the present embodiment.

FIG. 2 is a perspective external view of a developing device 3*a* according to an embodiment of the present disclosure. FIG. 3 is a schematic side sectional view of the developing device 3*a* of the present embodiment. Note that FIG. 3 shows the developing device 3*a* as seen from a rear side of FIG. 1, so that arrangement of each member in the developing device 3*a* appears to be reversed left to right as compared with FIG. 1. Further, in the following descriptions, only the developing device 3*a* arranged in the image forming portion Pa of FIG. 1 will be dealt with as an example, and the developing devices 3*b* to 3*d* arranged in the image forming portions Pb to Pd will be not described. This is because each of the developing devices 3*b* to 3*d* has basically the same structure as the developing device 3*a*. Further, in the following descriptions, a near side of the main body of the color printer 100 will be referred to as a front side, and a far side of the main body of the color printer 100 will be referred to as a rear side. For example, in FIG. 2, the left end of the developing device 3*a* is on the front side and the right end of the developing device 3*a* is on the rear side.

As shown in FIG. 2 and FIG. 3, the developing device 3*a* includes a developing container (casing) 20 for storing a two-component developer. The developing container 20 is partitioned by a partition wall 20*a* into a stirring-conveyance chamber 21 and a supply-conveyance chamber 22. The stirring-conveyance chamber 21 and the supply-conveyance chamber 22 are provided with a stirring-conveyance screw 25*a* and a supply-conveyance screw 25*b*, respectively, for mixing and stirring toner (positively charged toner) to be supplied from the toner container 4*a* (see FIG. 1) with carrier to charge the toner.

The developer is conveyed in an axial direction (direction perpendicular to a surface of the sheet on which FIG. 3 is drawn) while being stirred by the stirring-conveyance screw 25*a* and the supply-conveyance screw 25*b*, and the developer circulates between the stirring-conveyance chamber 21 and the supply-conveyance chamber 22 through a developer passage (not shown) formed at each end portion of the partition wall 20*a*. In other words, inside the developing container 20, a developer circulation path is formed of the stirring-conveyance chamber 21, the supply-conveyance chamber 22, and the developer passages.

The developing container 20 extends obliquely right upward in FIG. 3, and in the developing container 20, a toner supply roller 30 is disposed above the supply-conveyance screw 25*b*, and a developing roller 31 is disposed obliquely to the upper right of the toner supply roller 30, opposite the toner supply roller 30. The developing roller 31 is disposed opposite to the photosensitive drum 1*a* (see FIG. 1) on an opening side (right side in FIG. 3) of the developing container 20. The toner supply roller 30 and the developing roller 31 are rotatable about respective rotary shafts in a counterclockwise direction in FIG. 3.

In the stirring-conveyance chamber 21, there is provided an unillustrated toner concentration sensor facing the stirring-conveyance screw 25*a*. Based on a detection result from the toner concentration sensor, toner is supplied from the toner container 4*a* to the stirring-conveyance chamber 21 via an unillustrated toner supply port. Used as the toner concentration sensor is, for example, a magnetic permeability sensor which detects the magnetic permeability of the two-component developer containing toner and magnetic carrier in the developing container 20.

The toner supply roller 30 is a magnetic roller composed of a non-magnetic rotary sleeve that rotates in the counterclockwise direction in FIG. 3, and a stationary magnet body having a plurality of magnetic poles enclosed in the rotary sleeve.

The developing roller 31 is composed of a cylindrical developing sleeve which rotates in the counterclockwise direction in FIG. 3, and a developing-roller-side magnetic pole fixed in the developing sleeve. The toner supply roller 30 and the developing roller 31 are opposed to each other over a predetermined gap at a facing position (opposing position). The developing-roller-side magnetic pole has a polarity reverse to the polarity of such a magnetic pole (a main pole) in the stationary magnet body as is opposed to the developing-roller-side magnetic pole.

To the developing container 20, a trimming blade (regulation blade) 33 is fitted along a longitudinal direction of the toner supply roller 30 (direction perpendicular to the surface of the sheet on which FIG. 3 is drawn). The trimming blade 33 is fastened and secured to a blade support stay 35 mounted on the developing container 20 by using a blade fastener screw (not shown), and is positioned on a more upstream side than the opposing position of the developing roller 31 and the toner supply roller 30 in a rotational direction of the toner supply roller 30 (the counterclockwise direction in FIG. 3). A slight space (gap) is formed between a leading end portion of the trimming blade 33 and a surface of the toner supply roller 30.

A direct-current voltage (hereinafter, called Vslv (DC)) and an alternating-current voltage (hereinafter, called Vslv (AC)) are applied to the developing roller 31. A direct-current voltage (hereinafter, referred to as Vmag (DC)) and an alternating-current voltage (hereinafter, referred to as Vmag (AC)) are applied to the toner supply roller 30. These direct-current voltages and alternating-current voltages are applied to the developing roller 31 and the toner supply roller 30 from a developing bias power source via a bias control circuit (neither of which is shown).

As described above, the developer is stirred by the stirring-conveyance screw 25*a* and the supply-conveyance screw 25*b* and circulates in the stirring-conveyance chamber 21 and the supply-conveyance chamber 22 in the developing container 20, whereby toner particles in the developer are charged. The developer in the supply-conveyance chamber 22 is conveyed to the toner supply roller 30 by the supply-conveyance screw 25*b*. And, a magnetic brush (not shown) is formed on the toner supply roller 30. Layer thickness of the magnetic brush on the toner supply roller 30 is adjusted by the trimming blade 33, then the magnetic brush is conveyed, by rotation of the toner supply roller 30, to an opposing region of the toner supply roller 30 and the developing roller 31. And, a thin toner layer is formed on the developing roller 31 by using a potential difference ΔV between Vmag (DC) applied to the toner supplying roller 30 and Vslv (DC) applied to the developing roller 31, and a magnetic field.

Although thickness of the toner layer on the developing roller 31 varies depending on factors such as resistance of the developer, difference in rotation speed between the toner supply roller 30 and the developing roller 31, and the like, it is controllable by means of ΔV. The toner layer on the developing roller 31 becomes thicker as ΔV is increased, while it becomes thinner as ΔV is reduced. An appropriate range of ΔV during development is generally from approximately 100 V to 350 V.

The thin toner layer formed on the developing roller 31 through contact with the magnetic brush formed on the toner supply roller 30 is conveyed by the rotation of the developing roller 31 to an opposing region of the photosensitive drum 1*a* and the developing roller 31. Since Vslv (DC) and Vslv (AC) are applied to the developing roller 31, the toner particles are caused to jump from the developing roller 31 to the photosensitive drum 1*a* by potential difference between the developing roller 31 and the photosensitive drum 1*a*, whereby the electrostatic latent image on the photosensitive drum 1*a* is developed.

Toner particles remaining without being used for development is conveyed back to the opposing portion of the developing roller 31 and the toner supply roller 30, and is collected by the magnetic brush formed on the toner supply roller 30. Then, the magnetic brush is peeled off from the toner supply roller 30 at a homopolar portion of the stationary magnet body, and falls into the supply-conveyance chamber 22.

Thereafter, based on a detection result from the toner concentration sensor (not shown), a predetermined amount of toner is supplied via the toner supply port (not shown) into the developing container 20 to be circulated in the supply-conveyance chamber 22 and the stirring-conveyance chamber 21, whereby the two-component developer is uniformly charged again and the concentration of toner therein is recovered to an appropriate value. This developer is supplied again onto the toner supply roller 30 by the supply-conveyance screw 25*b* to form a magnetic brush, which is conveyed to the trimming blade 33.

On a right-side wall of the developing container 20 in FIG. 3, a sleeve cover 37 having a substantially V shape in section is disposed near the developing roller 31 to project to an inside of the developing container 20. As shown in FIG. 3, the sleeve cover 37 is disposed along a longitudinal direction of the developing container 20 (direction perpendicular to the surface of the sheet on which FIG. 3 is drawn), and an upper surface 37*a* of the sleeve cover 37 (see FIG. 4) constitutes an inner wall portion which is opposed to the developing roller 31 inside the developing container 20.

A sheet-shaped seal member 39 is disposed at an upper end of the sleeve cover 37. The seal member 39 extends in a longitudinal direction of the sleeve cover 37 (direction perpendicular to the surface of the sheet on which FIG. 3 is drawn) in such a manner that a leading end portion thereof contacts the surface of the photosensitive drum 1*a* (see FIG. 1), and the seal member 39 has a function to block toner particles in the developing container 20 to prevent toner leakage to the outside.

Figure 4:
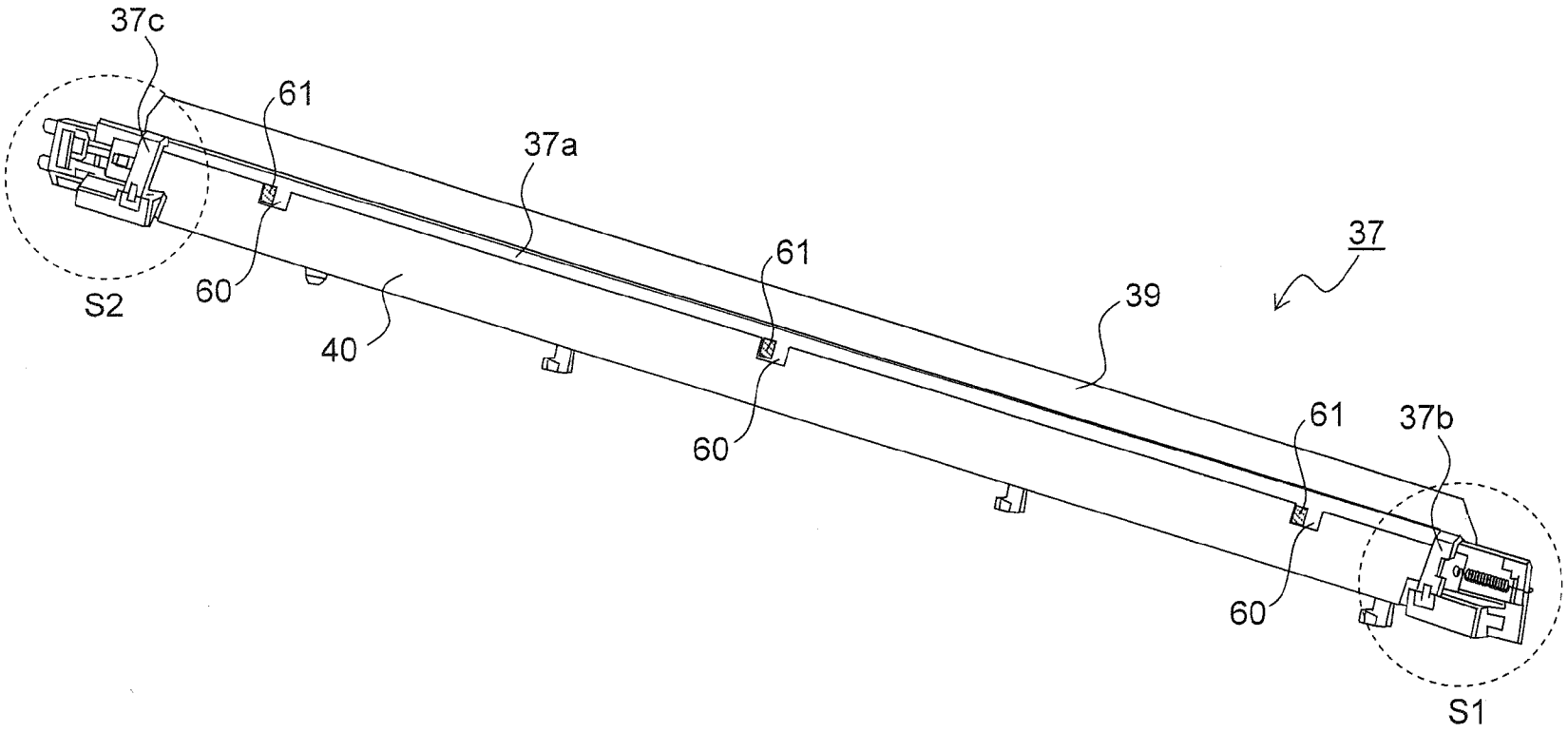
FIG. 4 is a perspective view of a sleeve cover used in the developing device of the present disclosure, as seen from inside a developing container.

FIG. 4 is a perspective view of the sleeve cover 37 as seen from inside the developing container 20 (from the left side in FIG. 3). A film member 40 is supported on the upper surface 37*a* of the sleeve cover 37 along the longitudinal direction. The film member 40 is formed of a flexible resin material such as a PET film and the like, and, as shown in FIG. 4, disposed over a substantially entire area (part opposed to an entire area of the developing roller 31 along the longitudinal direction) of the upper surface 37*a* of the sleeve cover 37. Here, it is preferable for the film member 40 to be formed to be more unlikely to attract toner particles than the sleeve cover 37 by using a fluororesin film and the like as the material of the film member 40 or coating the film member 40 with a fluororesin. Further, the film member 40 is reciprocated with tension given thereto as described later, and accordingly needs to have some restoration force (elasticity).

Formed at end portions on a front side (right side in FIG. 4) and a rear side (left side in FIG. 4) of the upper surface 37*a* of the sleeve cover 37 are guide portions 37*b*, 37*c*, into each of which an end portion of the film member 40 is inserted. The end portion of the film member 40 on the rear side extends through the guide portion 37*c* more into the rear side such that a tip end of the end portion is positioned in the vicinity of an idle gear 41 (see FIG. 6) which is disposed on the rear side of developing device 3*a*.

In an upper end portion of the film member 40, three rectangular cut portions 60 are formed, one at each of three positions in the vicinities of a center and both ends in the longitudinal direction. Further, the sleeve cover 37 is provided with engagement projection portions 61 disposed opposite the cut portions 60. The cut portions 60 and the engagement projection portions 61 constitute an oscillation mechanism which causes the upper end portion of the film member 40 to oscillate along with later-described reciprocation of the film member 40.

Figure 5:
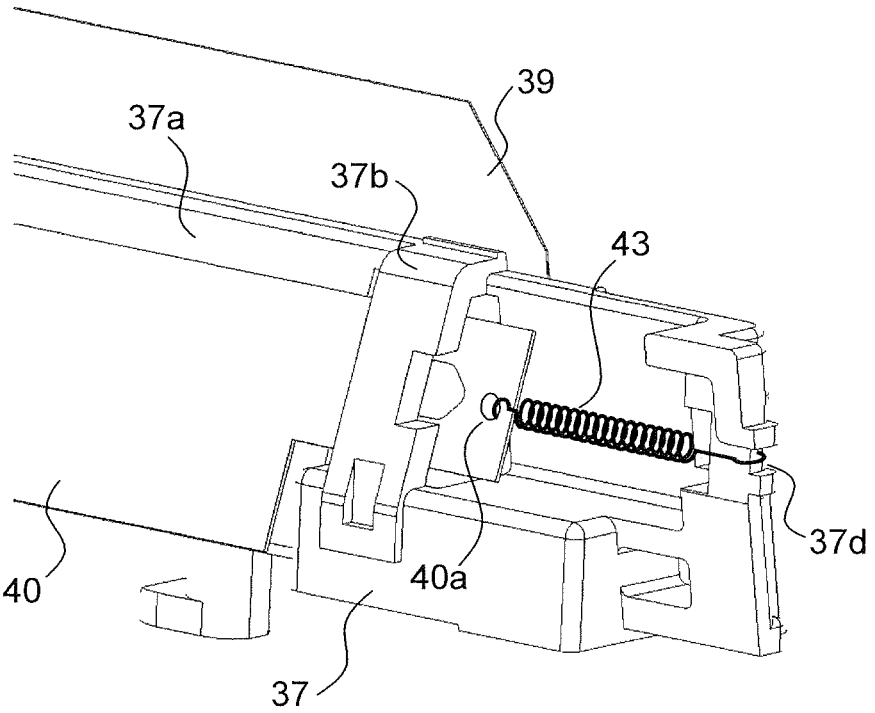
FIG. 5 is an enlarged view of a part around a front-side end portion of the sleeve cover used in the developing device of the present disclosure.
Figure 6:
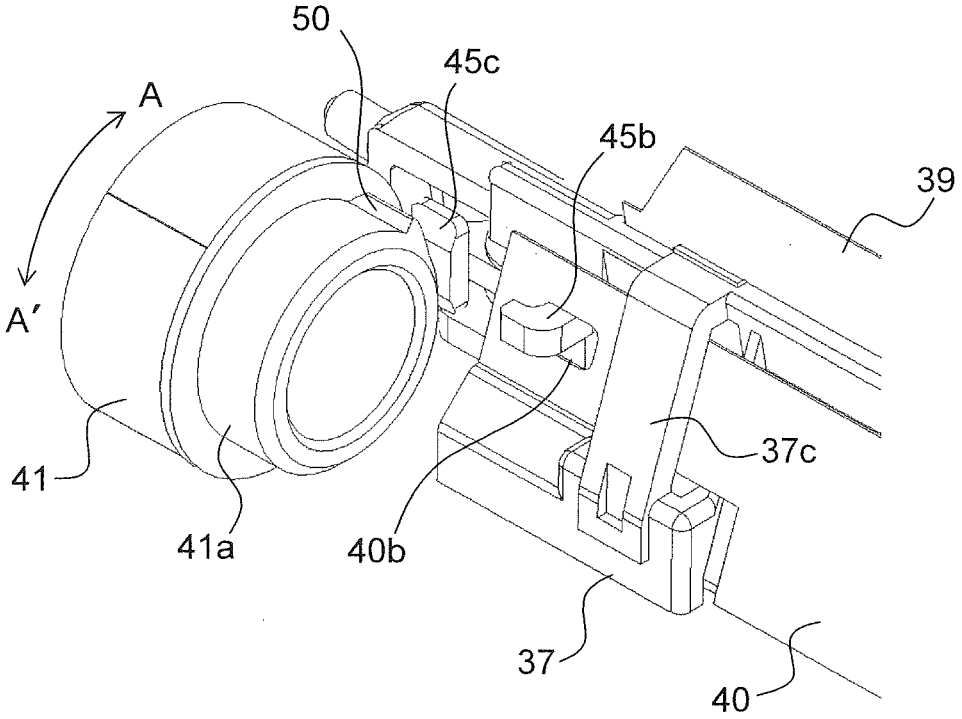
FIG. 6 is an enlarged view of a part around a rear-side end portion of the sleeve cover used in the developing device of the present disclosure.
Figure 7:
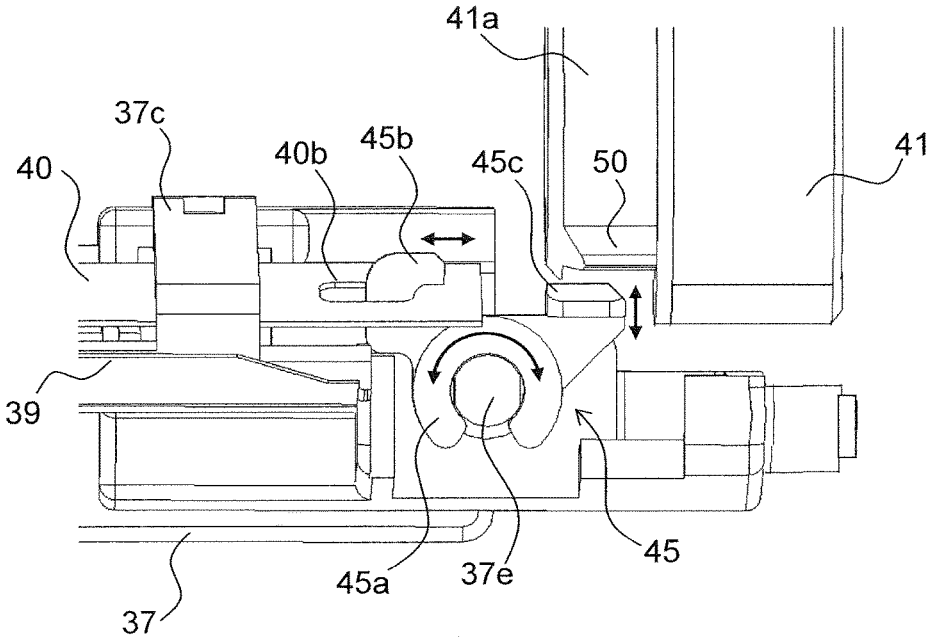
FIG. 7 is a plan view of the part around the rear-side end portion of the sleeve cover, as seen from above in FIG. 6.

FIG. 5 is an enlarged view of a part (inside the broken-line circle S1 in FIG. 4) around a front-side end portion of the sleeve cover 37, FIG. 6 is an enlarged view of a part (in the broken-line circle S2 in FIG. 4) around a rear-side end portion of the sleeve cover 37, and FIG. 7 is a plan view of the part around the rear-side end portion of the sleeve cover 37, as seen from above. Note that FIG. 5 and FIG. 6 show the sleeve cover 37 and the film member 40 as seen from inside the developing device 3*a* (from the left side in FIG. 3).

As shown in FIG. 5, on the front side of the sleeve cover 37, one end of a coil spring 43 is hooked in an engagement hole 40*a* of the film member 40. The other end of the coil spring 43 is hooked on an engagement portion 37*d* of the sleeve cover 37. On the other hand, as shown in FIG. 6 and FIG. 7, on the rear side of the sleeve cover 37, there is formed a rectangular engagement hole 40*b*, in which a hook portion 45*b* of a link member 45 engages.

With this configuration, one end (front-side end portion) of the film member 40 is biased by the coil spring 43 toward the front side, while the other end (rear-side end portion) of the film member 40 is restricted in movement by the engagement between the engagement hole 40*b* and the link member 45. As a result, a predetermined tensile force (tension) is given to the film member 40 in the longitudinal direction.

The link member 45 has a support portion 45*a* formed in a cylindrical shape, a hook portion 45*b* extending from the support portion 45*a*, and a trigger 45*c*. The support portion 45*a* is rotatably mounted around a boss portion 37*e* formed on the sleeve cover 37, such that the link member 45 is oscillatably supported with respect to the sleeve cover 37, with the support portion 45*a* serving as a fulcrum. The hook portion 45*b* engages in the engagement hole 40*b* of the film member 40. The trigger 45*c* is opposed to an outer peripheral surface of a cylindrical portion 41*a*, which is integrally formed on a side surface of the idle gear 41, the side surface being opposed to the film member 40. The link member 45 receives a biasing force from the coil spring 43 via the film member 40, such that the hook portion 45*b* is biased in a direction (counterclockwise direction in FIG. 7) approaching the film member 40.

On the outer peripheral surface of the cylindrical portion 41*a*, there is formed a mountain-shaped projection 50. The projection 50 can be put in contact with the trigger 45*c* by rotation of the cylindrical portion 41*a* caused when the idle gear 41 rotates.

In image formation, when the toner supply roller 30 and the developing roller 31 are driven to rotate, the idle gear 41, which transmits a drive force to a drive input gear (not shown) of the developing roller 31, also rotates in an arrow A direction in FIG. 6. At this time, the cylindrical portion 41*a* integrally formed on the idle gear 41 also rotates in the arrow A direction, so that the projection 50 formed on the cylindrical portion 41*a* intermittently comes into contact with the trigger 45*c* of the link member 45.

As a result, the link member 45 oscillates, with the support portion 45*a* serving as a fulcrum, so that the one end (rear-side end portion) of the film member 40 is intermittently pulled by the hook portion 45*b*. Thereby, the film member 40 is caused to longitudinally reciprocate (slide) quickly, expanding and contracting the coil spring 43, which is coupled to the other end (the end portion on the front side).

Figure 8:
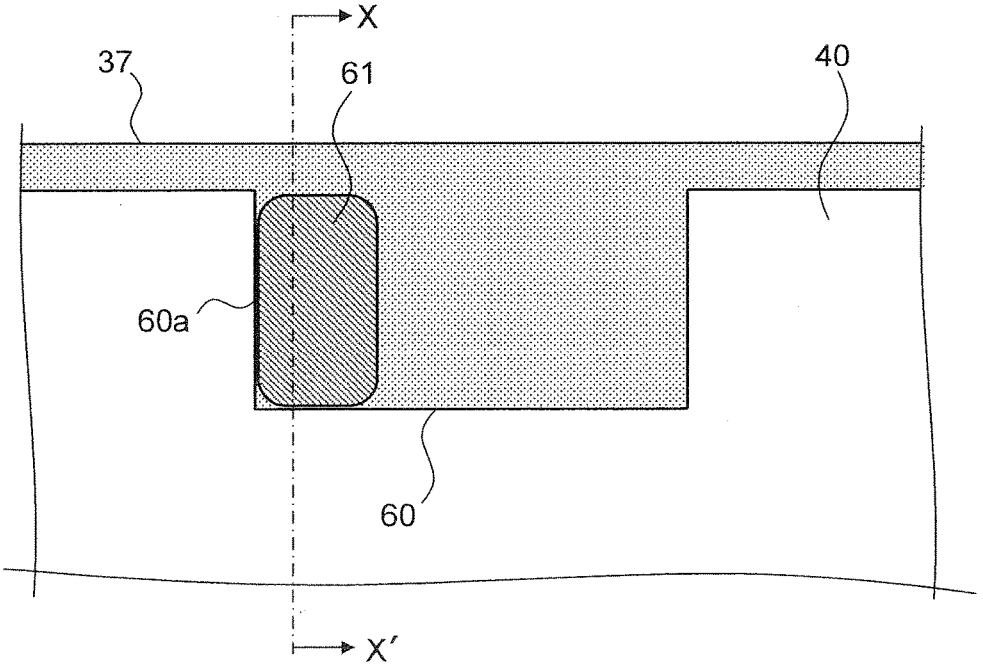
FIG. 8 is an enlarged plan view of a part around a cut portion in a state where a film member is disposed on a rearmost side of the sleeve cover.
Figure 9:
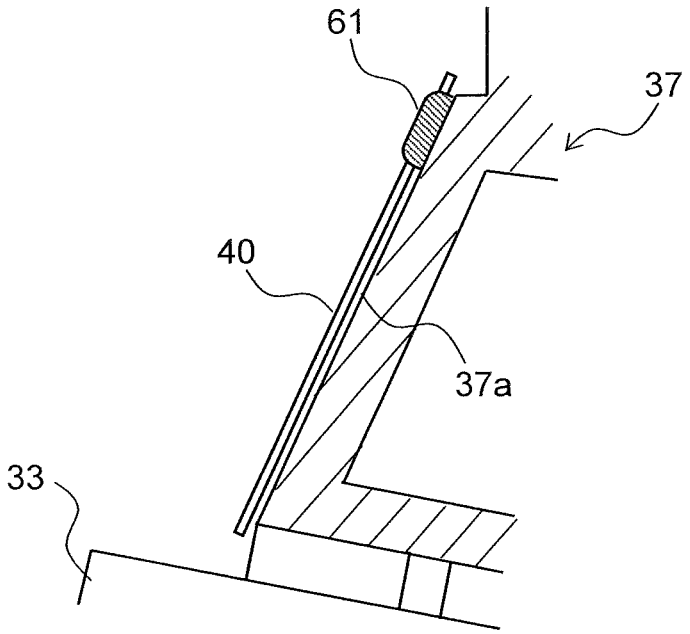
FIG. 9 is a side sectional view of the sleeve cover and the film member in the state shown in FIG. 8, as seen from the front side of the sleeve cover.

FIG. 8 is an enlarged plan view of a part around a cut portion 60 of the film member 40, and FIG. 9 is a side sectional view (sectional view taken along line XX' in FIG. 8) of the sleeve cover 37 and the film member 40 in the state shown in FIG. 8, as seen from the front side (right side in FIG. 4) of the sleeve cover 37. FIG. 8 shows a state where the projection 50 has come into contact with the trigger 45*c* (see FIG. 7) of the link member 45 and thus the film member 40 is pulled by the link member 45 (the hook portion 45*b*) to move to the rearmost side (left side in FIG. 4) of the sleeve cover 37. At this time, the film member 40 is disposed at a position (hereinafter, first position) at which an upstream-side edge 60*a* of the cut portion 60 with respect to a pulling direction of the coil spring 43 (rightward direction in FIG. 8) does not overlap with an engagement projection portion 61. As shown in FIG. 9, the film member 40 is disposed substantially parallel to the upper surface 37*a* of the sleeve cover 37.

Figure 10:
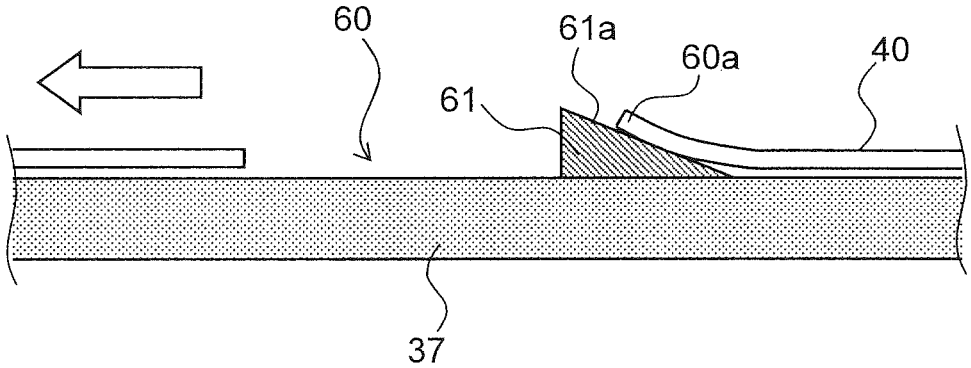
FIG. 10 is an enlarged view of the part around the cut portion, as seen from above, where the film member has moved to the front side of the sleeve cover from the state shown in FIG. 8.

FIG. 10 is an enlarged view of the part around the cut portion 60, where the film member 40 has moved to the front side of the sleeve cover 37 from the state shown in FIG. 8. As shown in FIG. 10, in the engagement projection portion 61, there is formed an inclined surface 61*a* which is inclined along a direction in which the film 40 moves. When, from the state shown in FIG. 8, the idle gear 41 rotates to release the contact between the projection 50 and the trigger 45*c* (see FIG. 7) of the link member 45 to allow the biasing force of the coil spring 43 to pull the film member 40 toward the front side (in the direction indicated by the outline arrow in FIG. 10), the upstream-side edge 60*a* of the cut portion 60 moves along upward inclination of the inclined surface 61*a* onto the engagement projection portion 61.

Figure 11:
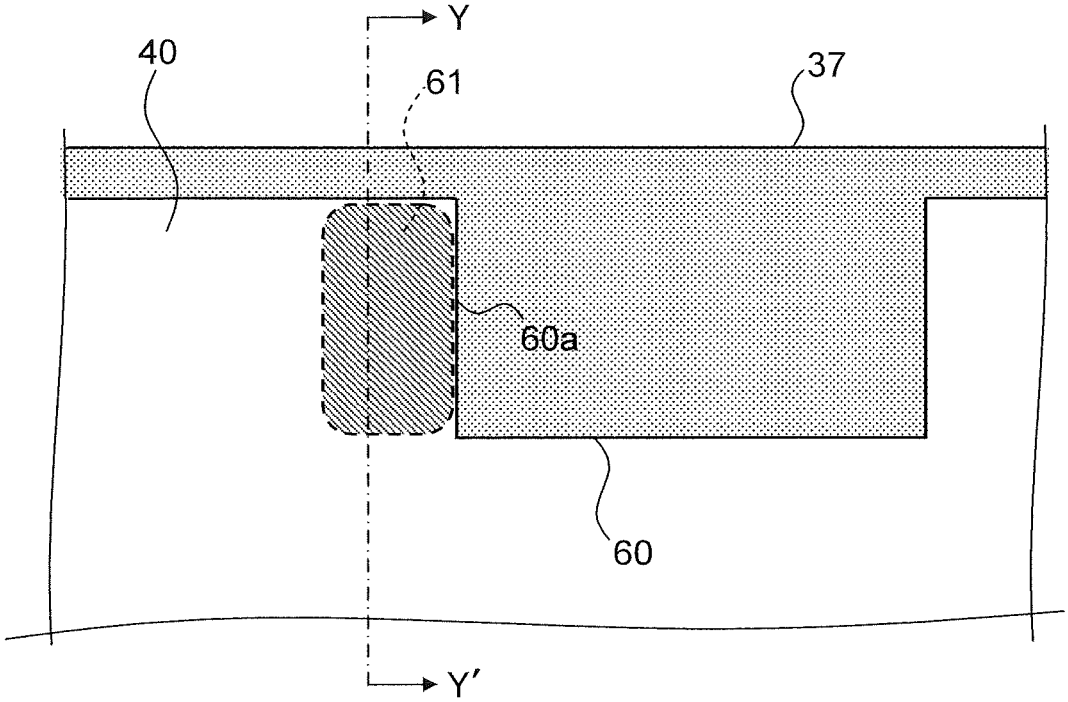
FIG. 11 is an enlarged plan view of the part around the cut portion where the film member has moved to the frontmost side of the sleeve cover from the state shown in FIG. 10.
Figure 12:
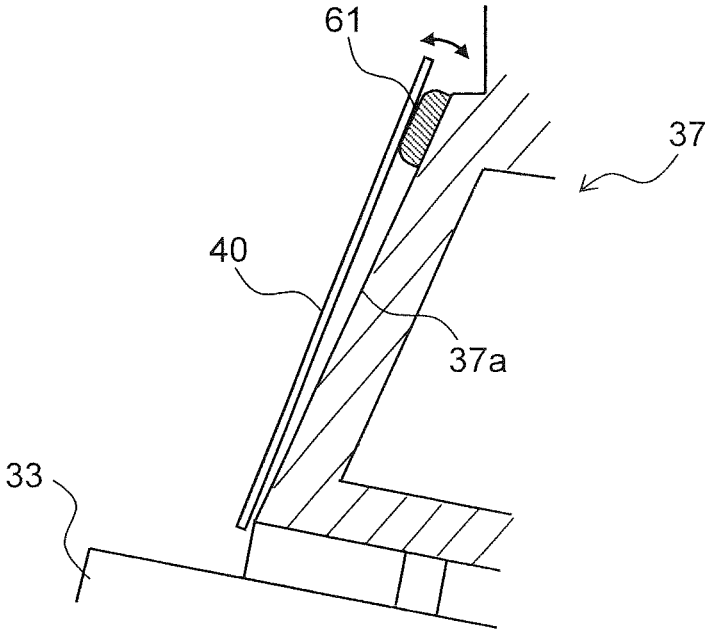
FIG. 12 is a side sectional view of the sleeve cover and the film member in the state shown in FIG. 11, as seen from the front side of the sleeve cover.

FIG. 11 is an enlarged plan view of the part around the cut portion 60, where the film member 40 has moved to the frontmost side of the sleeve cover 37, and FIG. 12 is a side sectional view (sectional view taken along line YY' in FIG. 11) of the sleeve cover 37 and the film member 40 in the state shown in FIG. 11, as seen from the front side (right side in FIG. 4) of the sleeve cover 37. When the film member 40 is caused by the biasing force of the coil spring 43 to move to the frontmost side, the film member 40 moves to a position (hereinafter, second position) at which the upstream-side edge 60*a* of the cut portion 60 is up on the engagement projection portion 61 as shown in FIG. 11. At this time, as shown in FIG. 12, the upper end portion of the film member 40 is lifted by the engagement projection portion 61 and a gap is formed between the upper end portion and the upper surface 37*a* of the sleeve cover 37.

In this manner, during its longitudinal reciprocation, the film member 40 alternately takes the states shown in FIGS. 9 and 12 repeatedly. That is, the upper end portion of the film member 40 oscillates in a direction (indicated by arrows in FIG. 12) orthogonal to the upper surface 37*a* of the sleeve cover 37, with a lower end portion of the film member 40 serving as a fulcrum.

Figure 13:
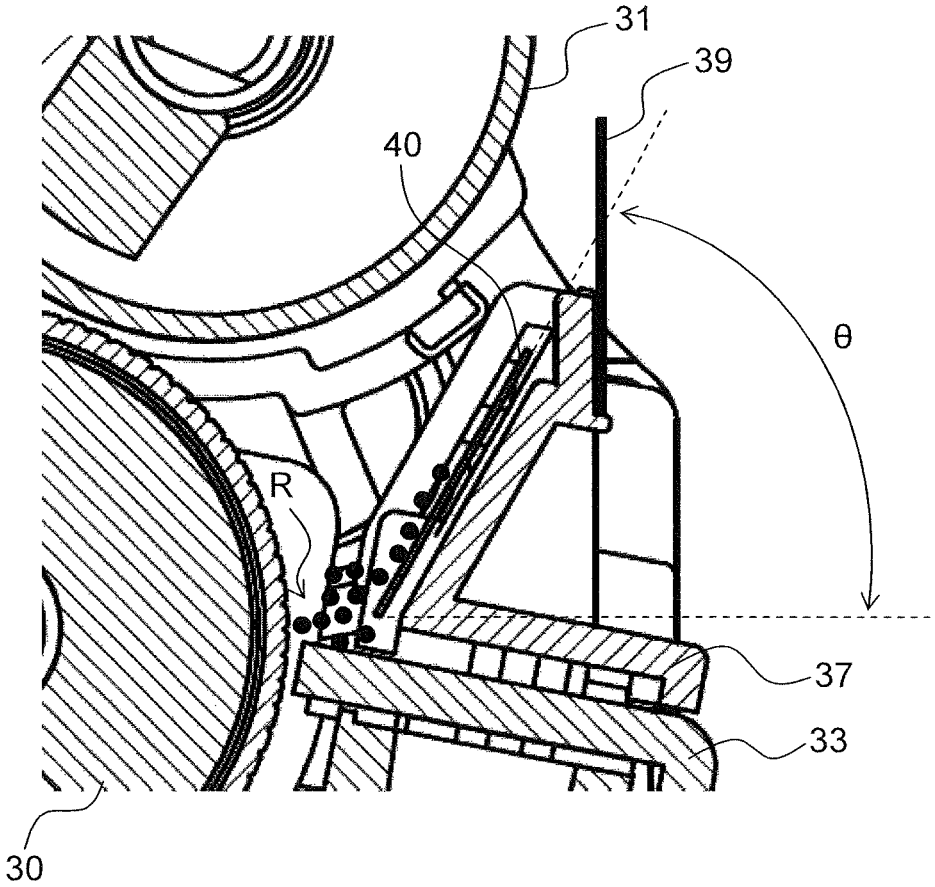
FIG. 13 is a side sectional view of a part of the developing device near the sleeve cover of the present embodiment.

FIG. 13 is a side sectional view of a part of the developing device 3*a* of the present embodiment near the sleeve cover 37. By the reciprocation of the film member 40 and the oscillation of the upper end portion of the film member 40 described above, toner particles accumulated on the film member 40 are made to leave the film member 40 and shaken off as shown in FIG. 13. In particular, when the upper end portion of the film member 40 oscillates, toner particles accumulated on the film member 40 are thrown up toward the toner supply roller 30. The toner particles thrown up from the film member 40 toward the toner supply roller 30 fall down along the film member 40 into a region R between the sleeve cover 37 and the toner supply roller 30.

Thereby, even in a case where the toner supply roller 30 and the developing roller 31 in the developing device 3*a* rotate at high rates and a large amount of toner particles float inside the developing container 20, it is possible to reduce accumulation of toner particles on the upper surface 37*a* of the sleeve cover 37. As a result, without relying on linear velocities of the toner supply roller 30 and the developing roller 31, it is possible to effectively reduce image defects, such as toner dropping and the like, caused by toner particles accumulating on the upper surface 37*a* of the sleeve cover 37 to aggregate into a block (blocking) adhering to the toner supply roller 30 or the developing roller 31.

Here, the entire film member 40 reciprocates along the longitudinal direction, and further, the oscillation mechanism composed of the cut portion 60 and the engagement projection portion 61 is formed one at each of a plurality of (here, three) positions in the film member 40 along its longitudinal direction. The provision of the plurality of oscillation mechanisms helps achieve the effect of uniformly shaking off toner particles accumulated on the film member 40 in the longitudinal direction of the film member 40, and thus, wherever on the film member toner particles may accumulate, they can be equally shaken off from the film member 40. For easy falling of toner particles from the film member 40, it is preferable for the film member 40 to be inclined by an inclination angle $\delta$ of 55° or larger with respect to a horizontal plane.

Further, the toner particles thrown up toward the toner supply roller 30 are partly collected by the magnetic brush formed on the outer peripheral surface of the toner supply roller 30. According to the present embodiment, when the developing device 3*a* is driven, the film member 40 reciprocates, and further, the upper end portion of the film member 40 oscillates, as a result of which toner particles fallen from the developing roller 31 are quickly shaken off without being allowed to accumulate on the film member 40. Here, toner particles immediately after falling from the developing roller 31 have not lost anything of their charge amount, and hence, even if such toner particles are supplied again onto the developing roller 31 after being collected by the magnetic brush of the toner supply roller 30, there is no risk of negative effects on a developing operation.

Further, since the accumulation of toner particles is prevented by the reciprocation of the film member 40, there is no need of additionally providing a toner removing member such as a brush member to remove toner particles from the sleeve cover 37, and thus, a compact and space-saving configuration is obtained. Furthermore, there is no risk of foreign matter attributable to a toner removing member circulating together with the developer in the developing container 20, and this helps effectively prevent foreign matter from clogging the gap between the trimming blade 33 and the toner supply roller 30 to cause image defects such as a void image and the like.

Moreover, the film member 40 is reciprocated by using the rotation of the idle gear 41 which is used to drive the toner supply roller 30 and the developing roller 31 to rotate, and thus, there is no need of additionally providing a dedicated motor, an actuator, and the like for giving vibration to the film member 40, and thus, it is also possible to simplify an internal configuration of the developing device 3*a*.

Here, to return toner particles fallen into the region R back into the supply-conveyance chamber 22, it is preferable to rotate the toner supply roller 30 during non-image formation in a direction (clockwise direction in FIG. 13) reverse to a direction in which it rotates during image formation. Along with the reverse rotation of the toner supply roller 30, toner particles fallen into the region R and temporarily accumulated near the leading end portion of the trimming blade 33 are collected by the magnetic brush formed on the surface of the toner supply roller 30, and rotate with the toner supply roller 30 to pass through the gap between the toner supply roller 30 and the trimming blade 33. Then, the toner particles are removed from the toner supply roller 30 at the homopolar portion of the stationary magnet body, and forcibly returned into the supply-conveyance chamber 22 (see FIG. 3)

As for timing of the reverse rotation of the toner supply roller 30, the timing may be set as necessary to a time when the image forming apparatus 100 is started up (when the power is turned on), a time when the image forming apparatus 100 is recovered from a power saving (sleep) mode or a time when printing on a predetermined number of sheets is finished, and the like, in accordance with the extent of the accumulation of toner particles on the film member 40.

Note that, in a case where the toner supply roller 30 is rotated in the direction reverse to the direction in which it is rotated during image formation, the idle gear 41 also rotates in a direction (arrow A' direction in FIG. 6) reverse to a direction in which the idle gear 41 rotates during image formation. In this case, too, the projection 50 formed on the cylindrical portion 41*a* intermittently comes into contact with the trigger 45*c* of the link member 45 to make the link member 45 oscillate to cause the film member 40 to reciprocate in the same manner as during image formation.

Since the film member 40 is configured to be made to reciprocate by the contact between the projection 50 formed in the cylindrical portion 41*a* of the idle gear 41 and the trigger 45*c* of the link member 45, an amplitude and a cycle of the reciprocation of the film member 40 can be changed by changing a projection amount of the projection 50 or a number of projections formed as the projection 50 as necessary.

Figure 14:
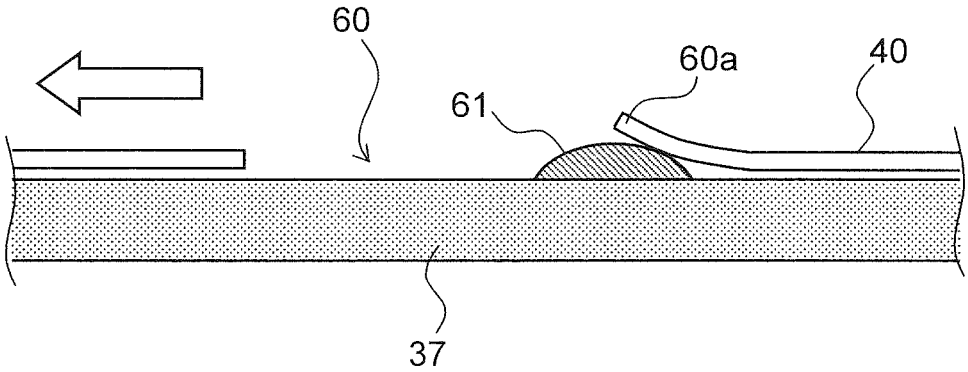
FIG. 14 is an enlarged view of a modified example of the developing device of the present embodiment, as seen from above, showing a part around a cut portion provided with an engagement projection portion which is shaped like a segment of a circle in a side view.

In the present embodiment, the engagement projection portion 61 includes the inclined surface 61*a*, and the upstream-side edge 60*a* of the cut portion 60 moves up along the inclined surface 61*a* onto the engagement projection portion 61; instead, for example, as shown in FIG. 14, the engagement projection portion 61 may be shaped like a segment of a circle in section such that the upstream-side edge portion 60*a* of the cut portion 60 moves up along a curved surface of the engagement projection portion 61.

Figure 15:
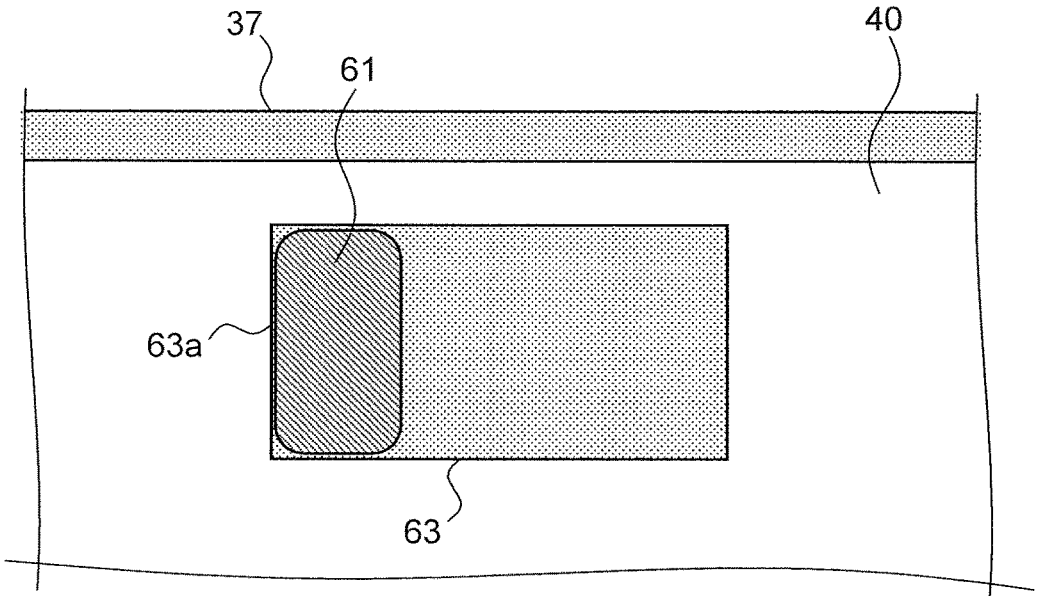
FIG. 15 is an enlarged plan view of a modified example of the developing device of the present embodiment in which the film member is provided with a rectangular window portion.
Figure 16:
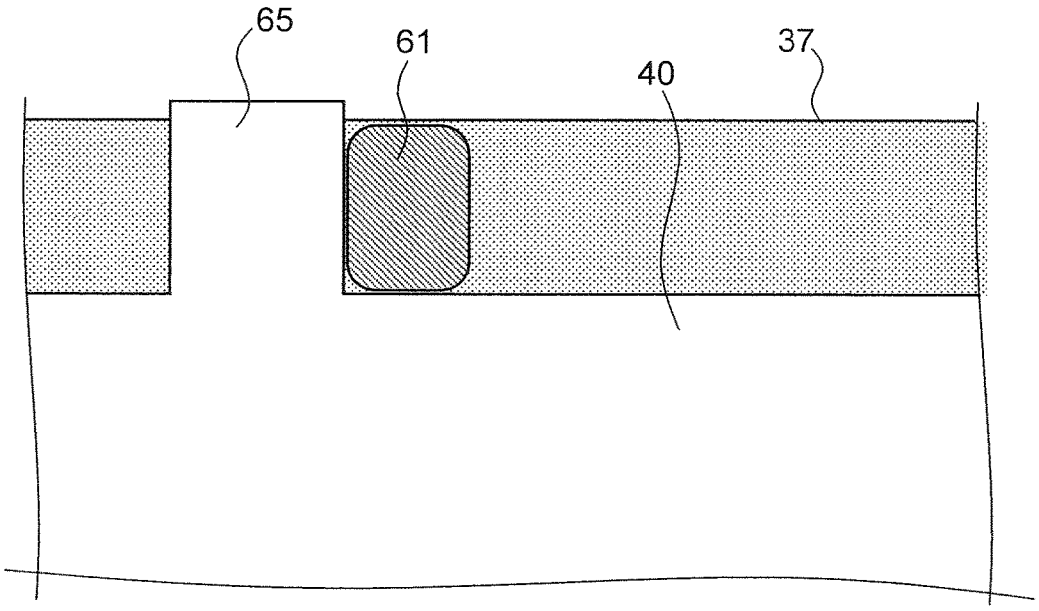
FIG. 16 is an enlarged plan view of a modified example of the developing device of the present embodiment in which the film member is provided with a rectangular projection portion.

Or, a window portion 63 as shown in FIG. 15 or a projecting piece 65 as shown in FIG. 16 may be provided instead of the cut portion 60 such that an upstream-side edge 63*a* of the wind portion 63 or the projecting piece 65 moves up onto the engagement projection portion 61 as the film member 40 moves in the longitudinal direction.

It should be understood that the present disclosure is not limited to the above embodiments, and various modifications are possible within the scope of the present disclosure. For example, the shapes and the configurations of the sleeve cover 37 and the film member 40 dealt with in the above embodiments are not meant as limitations but are merely examples, and the shapes and the configurations can be appropriately set in accordance with, for example, the configuration of the developing device 3*a*.

Specifically, in the above embodiments, the film member 40 is made to reciprocate by means of the trigger 45*c* provided on the link member 45 side and the projection 50 provided on the idle gear 41 side, but instead, the projection 50 may be provided on another gear in a drive gear train for driving the toner supply roller 30 or the developing roller 31 so as to intermittently come into contact with the trigger 45*c* to make the film member 40 reciprocate.

Figure 17:
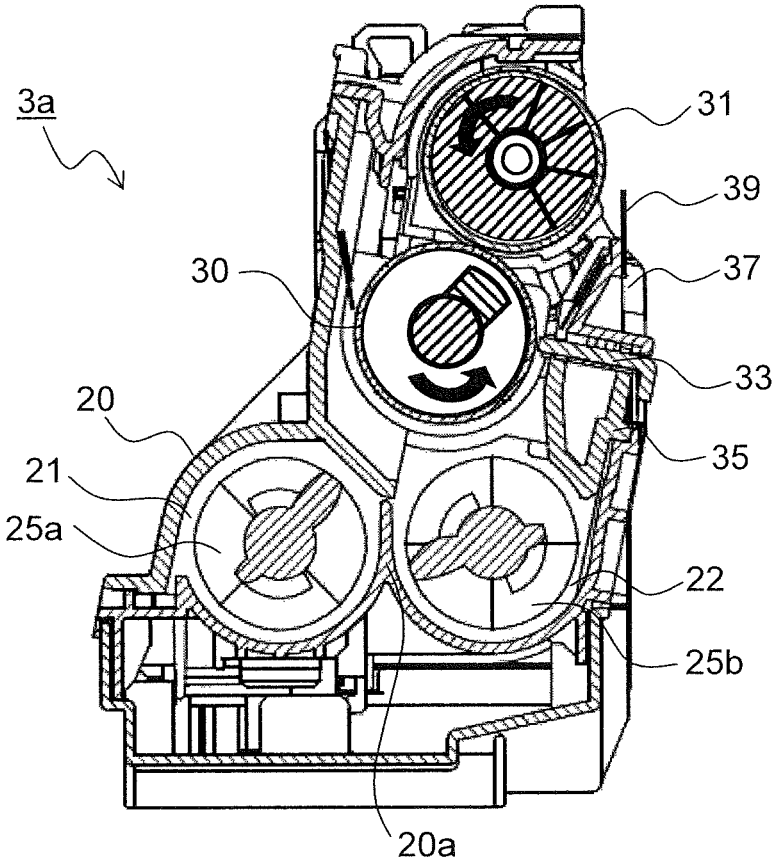
FIG. 17 is a side sectional view of a developing device of the present disclosure in which configurations of the toner supply roller and the developing roller are reverse to those in FIG. 3.

In the above embodiments, the present disclosure is applied to the developing devices 3*a* to 3*d* which each use a two-component developer, form a magnetic brush on the toner supply roller 30, transfer only toner from the toner supply roller 30 to the developing roller 31, and supply toner from the developing roller 31 to a corresponding one of the photosensitive drums 1*a* to 1*d*; the present disclosure is further applicable to developing devices configured otherwise, such as one as shown in FIG. 17, in which the positions of the developing roller 31 and the toner supply roller 30 are reverse relative to their positions in the above embodiments, toner is supplied to the photosensitive drums 1*a* to 1*d* from a magnetic brush formed of a two-component developer held on the surface of the developing roller 31 (which is, in this configuration, a magnetic roller having the same configuration as the toner supply roller 30 of the above embodiments), and toner held on the surface of the toner supply roller 30 (which, in this configuration, has the same configuration as the developing roller 31 of the above embodiments) is supplied to the developing roller 31 and excessive toner on the surface of the developing roller 31 is collected by using the toner supply roller 30. In this configuration, too, it is possible to effectively reduce accumulation of toner particles fallen from the developing roller 31 around the regulation blade 33 opposed to the toner supply roller 30.

The above embodiments have been described dealing with the tandem-type color printer 100 as an example, but needless to say, the present disclosure is applicable to other types of image forming apparatuses, such as monochrome and color copiers, digital multifunction peripherals, monochrome printers, and facsimile machines.

The present disclosure is usable in developing devices having an inner wall portion that is opposed to a developing roller between a blade and an image carrier inside a casing. By use of the present disclosure, it is possible to effectively reduce accumulation of toner on the inner wall portion inside the developing device. By providing such a developing device, it is possible to achieve an image forming apparatus capable of effectively preventing image defects, such as toner dropping and the like caused by toner accumulation.

What is claimed is:

1. A developing device comprising:

a developing roller
- which is disposed opposite an image carrier on which an electrostatic latent image is formed, and
- which, in an opposing region where the developing roller and the image carrier face each other, supplies developer to the image carrier;

a toner supply roller which is disposed opposite the developing roller, and which, in an opposing region where the toner supply roller and the developing roller face each other, supplies toner to the developing roller;

a regulation blade which is disposed opposite the toner supply roller with a predetermined space therebetween;

a casing which holds therein the developing roller, the toner supply roller, and the regulation blade, and which has an inner wall portion that is opposed to the developing roller between the regulation blade and the image carrier;

a film member which is flexible and disposed on an upper surface of the inner wall portion;

a biasing member which is coupled to one longitudinal end of the film member to give tension to the film member;

a link member which is coupled to another longitudinal end of the film member;

a link member drive mechanism which drives the link member to intermittently pull the film member to thereby cause reciprocation of the film member in a longitudinal direction; and an oscillation mechanism which causes an upper end portion of the film member to oscillate in a direction orthogonal to the upper surface of the inner wall portion along with the reciprocation of the film member, wherein the oscillation mechanism is composed of an engagement portion formed one at each of a plurality of positions in the upper end portion of the film member, and an engagement projection portion disposed on the inner wall portion to be positioned opposed to the engagement portion, and the upper end portion of the film member is caused to oscillate by the film member reciprocating between a first position at which an edge of the engagement portion does not overlap with the engagement projection portion and a second position at which the edge of the engagement portion is on the engagement projection portion.

2. The developing device of claim 1, wherein the film member is disposed at the second position by a biasing force of the biasing member, and the film member is caused to reciprocate between the first position and the second position by the link member intermittently pulling the film member against the biasing force of the biasing member.

3. The developing device of claim 1, wherein the engagement projection portion has an inclined surface ascending in a direction in which the film member moves from the first position to the second position.

4. The developing device of claim 1, wherein the engagement projection portion has a curved surface in a direction in which the film member moves from the first position to the second position, and the engagement projection portion is shaped like a segment of a circle in section.

5. The developing device of claim 1, wherein the link member drive mechanism is provided on a gear included in a drive gear train for driving the developing roller or the toner supply roller.

6. The developing device of claim 5, wherein the link member is oscillatably supported with respect to the casing, and the link member drive mechanism is a projection which intermittently comes into contact with the link member along with rotation of the gear.

7. The developing device of claim 6, wherein at least one of an amplitude of the film member and a reciprocation cycle of the film member is changeable by changing at least one of a projection amount of the projection and a number of positions at each of which the projection is provided.

8. The developing device of claim 1, wherein the toner supply roller is rotated, during non-image formation, in a direction reverse to a direction in which the toner supply roller is rotated during image formation.

9. The developing device of claim 1, wherein the toner supply roller is a magnetic roller, and carries a two-component developer, containing toner and carrier, by means of a plurality of magnetic poles provided inside the toner supply roller.

10. The developing device of claim 1, wherein the developing roller is a magnetic roller, and carries a two-component developer, containing toner and carrier, by means of a plurality of magnetic poles provided inside the developing roller.

11. An image forming apparatus comprising the developing device of claim 1.

* * * * *